US007523807B2

(12) United States Patent
Vroegindeweij et al.

(10) Patent No.: US 7,523,807 B2
(45) Date of Patent: Apr. 28, 2009

(54) TILT MECHANISM FOR THE MOVABLE PART OF A STAIRLIFT GUIDE

(75) Inventors: Dennis Vroegindeweij, Ursem (NL); Martinus Josephus Hester, Heerhugowaard (NL)

(73) Assignee: Freelift B.V., Heerhugowaard (NL)

( * ) Notice: Subject to any disclaimer, the term of this patent is extended or adjusted under 35 U.S.C. 154(b) by 59 days.

(21) Appl. No.: 10/558,460

(22) PCT Filed: Jun. 2, 2004

(86) PCT No.: PCT/NL2004/000394

§ 371 (c)(1),
(2), (4) Date: Dec. 11, 2006

(87) PCT Pub. No.: WO2004/108578

PCT Pub. Date: Dec. 16, 2004

(65) Prior Publication Data

US 2007/0272487 A1 Nov. 29, 2007

(30) Foreign Application Priority Data

Jun. 4, 2003 (NL) ..... 1023592

(51) Int. Cl.
*B66B 9/08* (2006.01)

(52) U.S. Cl. ..... 187/201; 187/202

(58) Field of Classification Search ..... 187/200–202
See application file for complete search history.

(56) References Cited

U.S. PATENT DOCUMENTS

| | | | | | |
|---|---|---|---|---|---|
| 4,674,601 | A | * | 6/1987 | Benjamin | 414/680 |
| 5,105,914 | A | * | 4/1992 | Holden | 187/201 |
| 5,624,009 | A | * | 4/1997 | Benjamin et al. | 187/201 |

FOREIGN PATENT DOCUMENTS

| | | | | |
|---|---|---|---|---|
| GB | 2296908 | A | * | 7/1996 |
| WO | WO 90/08091 | A1 | | 7/1990 |
| WO | WO 9726207 | A1 | * | 7/1997 |
| WO | WO 03/04399 | A1 | | 1/1999 |
| WO | WO 99/42399 | A1 | | 8/1999 |
| WO | WO 9942399 | A1 | * | 8/1999 |

* cited by examiner

*Primary Examiner*—Peter M Cuomo
*Assistant Examiner*—Eric Pico
(74) *Attorney, Agent, or Firm*—The Webb Law Firm

(57) ABSTRACT

The present invention relates to a device for transport along a staircase of persons and/or goods, which staircase extends between two platforms, and wherein the device includes: a guide which in the arranged situation extends at least along the staircase, a stationary segment and at least one tiltable segment; a tilting mechanism between the segments so as to selectively tilt the tiltable segment between a position lying in line with the stationary segment and a position substantially folded out of the space above one of the platforms; a carriage with transport means for persons and/or goods and a drive for advancing movement along the guide; and a transmission to selectively engage the carriage in the vicinity of the tilting mechanism to transmit movement of the carriage along the guide onto the tiltable segment for a tilting movement thereof.

15 Claims, 4 Drawing Sheets

TILT MECHANISM FOR THE MOVABLE PART OF A STAIRLIFT GUIDE

The present invention relates to a device for transport along a staircase of persons and/or goods, such as a stair lift or a stair walking aid, which staircase extends between two platforms. The guide is used to guide a carriage therealong, for instance a carrier or a stair walking aid. The carrier serves for instance as chair for transporting a person, as in the case of the above mentioned example of a stair lift. The invention likewise relates to a guide per se for such a device.

According to the known art the guide can be formed by a single tube having thereon engaging means for the carrier which must be displaced along the guide in the form of a tube. It is also possible for more than one guide, for instance in the form of a tube, to be arranged. However, for proper functioning of the carrier a guide in the form of a single tube necessarily extends in areas where it can form a hindrance to other people. For instance in the case of a stair lift, a guide in the form of a tube extends at the bottom of the staircase into a corridor or hallway or landing in order to enable the carrier or stair walking aid to be provided with a sufficient range of movement. Here however it forms an obstruction for free passage of goods and persons not needing to make use of the device. Such an obstruction can even be an obstacle when there is the danger of someone walking past catching on it. Such a drawback is even considerable when it is considered that a user of for instance a stair lift usually has problems walking. The guide of the stair lift, which serves as aid in ascending or descending a staircase, thus forms a considerable hindrance to this same user. A protruding part of such a guide can also form an obstruction to opening or closing of doors on a landing or in a hallway.

It is noted that the platforms are usually referred to as the hallway or a landing of a building, or can comprise comparable elements of a building to or from which the staircase runs.

Devices are known wherein the guide consists of stationary and movable components. Use is made here in the known art of a separate drive in each case for moving the stationary component or components. The control hereby becomes complex and possible embodiments become expensive due to the complex control and the use of an additional motor. Such a device also requires safety precautions, for instance to prevent limbs being caught between the parts movable relative to each other, or to prevent the carriage continuing to travel along the guide while these parts are not aligned. This latter could result in a dangerous situation, wherein the carriage can become detached from the guide.

The present invention has for its object to obviate or at least alleviate the above stated and other drawbacks of the known art. To this end a device according to the invention has the features of claim 1.

In a device according to the invention it is made possible for use to be made of the advancing movement of the carriage to realize the tilting movement. With such a manner of realizing the tilting a reliable and safe solution is provided to the problems of the known art, without additional motors or complex control thereof.

A device according to the invention preferably has the further features of claim 2. If the arm is moved in the longitudinal direction of the guide after engaging the passing carriage with the engaging means, the transmission brings about a suitable tilting movement of the tiltable segment, since the transmission is coupled to the tiltable segment. The device can herein display the features of claim 3. A passing carriage is then engaged by the lever and pivoted as a result of the movement of the carriage. The connection then brings about the movement of the arm which, due to the coupling between the arm and the tiltable segment, results in tilting of this segment.

A device according to the invention can further display the features of claim 4. A safety feature is required for the above stated reasons and can be realized according to the invention in accordance with claim 5 if there is then arranged between the arm and the lever a connection which is adapted to be broken at the threshold resistance or a higher resistance. This can of course also be realized on the other side of the separation between the segments, i.e. on the side of the tiltable segment where the arm acts thereon, or on both sides.

In yet another embodiment, a device according to the invention has the features of claim 6. A transmission with a selected transmission ratio has the advantage that both positions of the tiltable segment can be well defined. In for instance an above described embodiment with a safety feature against the influence of obstruction when the tiltable segment is folded away or folded out, it may be desirable to prevent the tiltable segment having to be moved through a dead centre, for instance an upright position, but that the upright position is sufficient to leave clear the space of the platform. The transmission ratio can herein be chosen to bring about this upright position and a position exactly in the line of the stationary segment. The movement of the arm also plays a part here, so that the embodiment of claim 7 provides a favourable and relatively simple manner of ensuring these positions, upright and in line with the stationary segment. The speed at which the tiltable segment is tilted between the positions can thus also be adjusted or selected.

As already noted, the invention also relates to a guide per se for a device in any of the above described or other embodiments of the invention.

Above mentioned and other features and advantages of the invention will be further elucidated hereinbelow with reference to a specific exemplary embodiment, to which the invention is however by no means limited. The embodiment is shown is the annexed drawings, in which.

Figure 1:
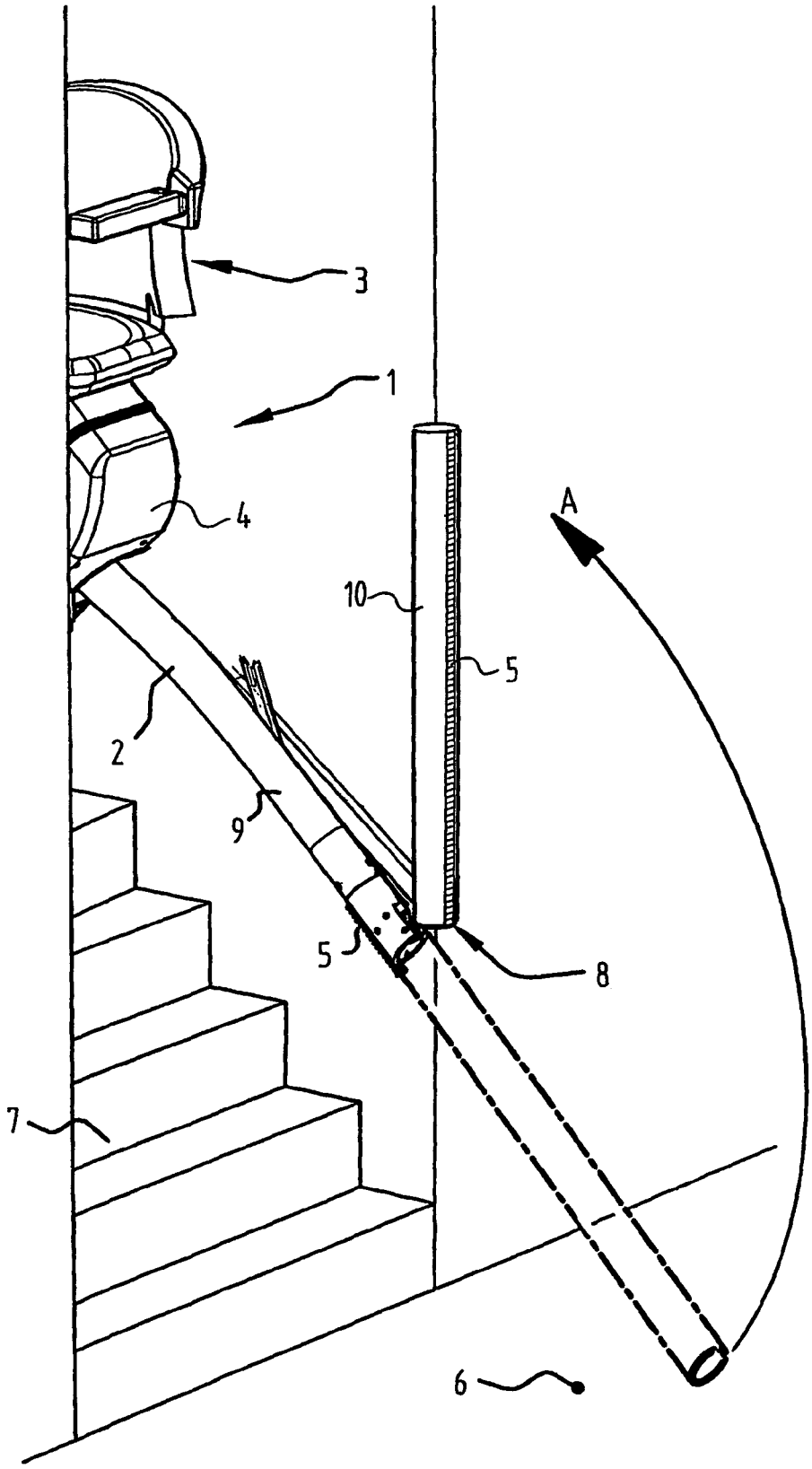
FIG. 1 shows a perspective view of a device with a guide in the form of a stair lift, both according to the present invention.

In FIG. 1 stair lift 1 is shown in perspective view as a possible embodiment of the invention. Stair lift 1 comprises a carriage in the form of a carrier 3 which is displaceable along a guide 2, which guide 2 is per se also designed according to the present invention. Carrier 3 is displaceable along guide 2 using a motor (not shown) in motor casing 4. This motor in motor casing 4 is for instance electric and engages with toothed wheels on gear rack 5 which extends along the whole guide 2.

FIG. 1 shows clearly that if the carriage in the form of carrier 3 were to be moved upward along guide 2, and no further measures were taken, a part of the guide 2 shown in dash-dot lines would protrude into the space 6 in front of staircase 7. The part of guide 2 protruding into the space 6 in question would represent a hindrance. However, guide 2 is provided with a tilting mechanism 8, whereby guide 2 is divided into a stationary segment 9 and a tiltable segment 10. The tiltable segment 10 can be folded away out of space 6 by means of the tilting mechanism 8 so that tiltable segment 10 no longer forms a hindrance or an obstacle in the space 6 located in front of staircase 7. The tilting movement is indicated in FIG. 1 with arrow A and it can be clearly seen that, in the situation where it is tilted out of space 6, the tiltable segment 10 no longer forms a hindrance or obstacle in front of staircase 7. From the position shown in full lines the tiltable segment 10 can be tilted to the position shown in dash-dot lines, so that the carriage formed from carrier 3 and motor casing 4 can cover the whole distance into space 6. The tiltable segment 10 is thus folded out when carriage 3,4 approaches along the rail, for which purpose a transmission 14 is applied.

The device comprises transmission 14 for converting a movement of the carriage or the motor casing 4 thereof into a tilting movement of tiltable segment 10.

Tilting mechanism 14 is shown in more detail in FIGS. 2 and 3 which are described together below.

A lever 11 is arranged on the stationary segment 9 for pivoting with pivot shaft 12. Lever 11 is pivotable between a position shown in full lines and a position shown with a broken line. The positions enclose an angle, wherein the positions lie substantially symmetrically relative to a plane through pivot shaft 12 substantially at right angles to the longitudinal direction of stationary segment 9 of guide 2. In the non-limitative embodiment shown here, the angle enclosed by the positions is 90 degrees, but can have a random other value. Lever 11 comprises a recess 16 which forms engaging means for engaging a pin 17 on carriage 3,4. As carriage 3,4 moves past lever 11, pin 17 drops into recess 16 and the lever is carried along by carriage 3,4 in a pivoting movement from the one to the other of the shown positions thereof.

A bush 13 is arranged on lever 11 at a distance from pivot point 12. This bush 13 is engaged by a clamp connection arranged on an arm 15. When the lever is tilted, arm 15 is thereby moved or displaced in the longitudinal direction of the guide, wherein a small rotation movement of the outer end of arm 15 occurs at lever 11.

Figure 4:
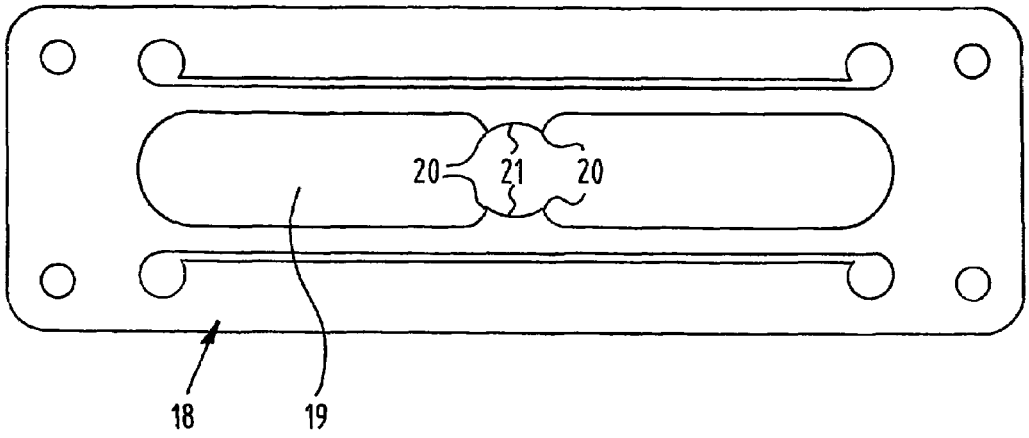
FIG. 4 shows a view of a detail of FIG. 3.

The clamp connection comprises a number of plates 18 of resilient material in which there is arranged a slotted hole 19. As also shown in figure 4, slotted hole 19 has, in or close to the centre thereof and as seen in lengthwise direction of arm 15, a narrowed portion 20, a widened portion 21 and another narrowed portion 20. In the situation of use the bush 13 drops into widened portion 21 and can rotate therein on its longitudinal axis, but owing to the resilience of the material of plates 18 the bush can spring out of the widened portion 21. This can happen if a resistant force to a tilting movement of tiltable segment 10 occurs which is higher than that caused by the weight of tiltable segment 10. The clamp connection thus serves as an embodiment of the above described safety feature.

Arm 15 extends from lever 11 to the tiltable segment 10 at a distance from tiltable segment 10, and is connected to the tiltable pivotable segment 10 via a transmission 22. This latter is formed by a slot 23 having therein a gear rack 24 along which a toothed wheel 25 can run rotatingly when arm 15 is moved or displaced in lengthwise direction thereof, i.e. when carriage 3,4 carries lever 11 along and lever 11 is pivoted from the one to the other of the shown positions thereof. Toothed wheel 25 is arranged on a tilting shaft 26 which forms a pivot axis for the tilting mechanism 8 in the form of a hinge. Tilting shaft 26 is further arranged on the hinge part 27 connected to tiltable segment 10, while the other hinge part 28 is mounted fixedly on stationary segment 9, wherein the other hinge part is coupled rotatably to tilting shaft 26, so that tiltable segment 10 is tilted when arm 15 is moved and toothed wheel 25 rolls over gear rack 24 in slot 23.

The diameter of toothed wheel 25, and thereby the transmission ratio of transmission 22, can be selected subject to the movement distance of arm 15 during a pivoting movement of lever 11, and thus to the distance between pivot shaft 12 and bush 13. This ratio is preferably chosen such that the tiltable segment stops in or before an upright position thereof as the carriage 3 moves away from tiltable segment 10, for the purpose of operation of the safety feature.

Figure 2:
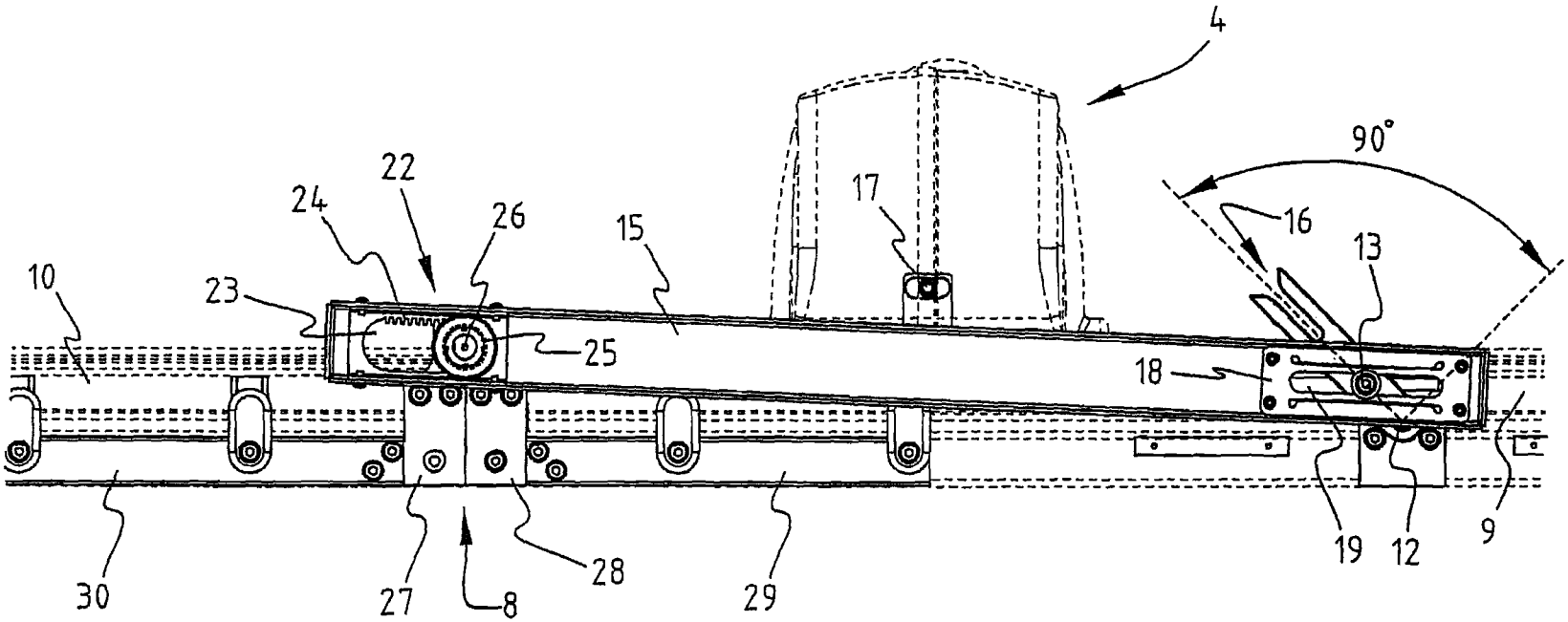
FIG. 2 is a rear view of the device with guide of FIG. 1.

Tilting shaft 26 is situated close to the top or above the guide so as to bring about an upward and then a downward tilting movement of tiltable segment 10 of the guide from the position thereof shown in FIG. 2.

Beams 29, 30 are arranged respectively under stationary segment 9 and under tiltable segment 10 on either side of tilting mechanism 8. Beams 29, 30 serve to increase the torsion rigidity of the guide in the vicinity of tilting mechanism 8. In a position of tiltable segment 10 wherein it extends in the line of stationary segment 9, the hinge parts 27, 28 lie against each other and are supported or shored at a distance from tilting shaft 26 by beams 29, 30, which can be formed for instance by hollow tubular profiles.

Figure 3:
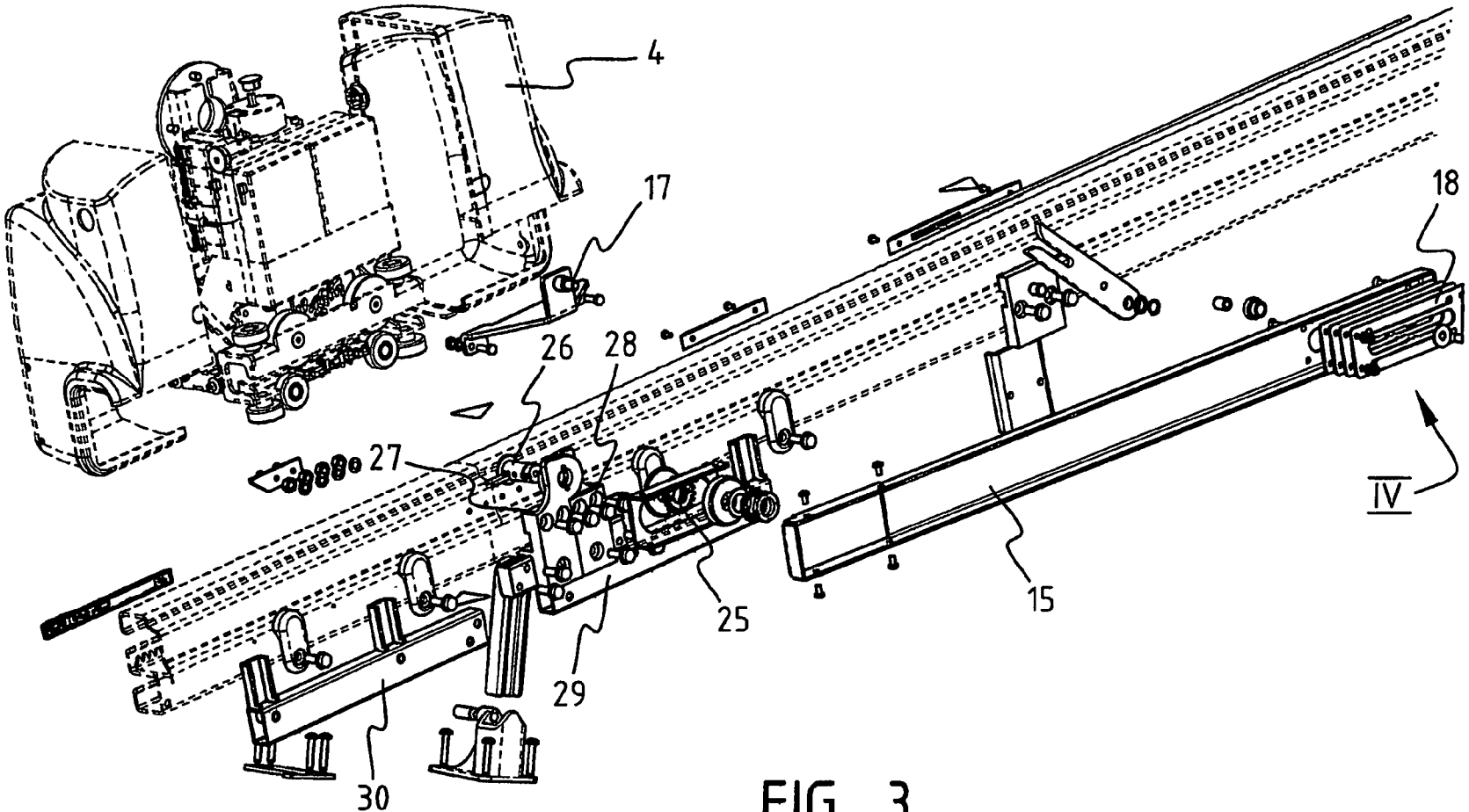
FIG. 3 is an exploded view of the assembly of components to be used to arrive at a configuration as according to FIG. 2.

FIG. 3 shows in much detail a possible embodiment of the configuration shown in FIG. 2. A detailed description is unnecessary, since all components in FIG. 3 will be immediately apparent to the skilled person.

It should however be noted that the configuration of FIG. 3 is reversible. Tilting shaft 26 comprises two pins 31, 32, one of which can be coupled to the hinge part associated with tiltable segment 10, and one of which can be coupled to toothed wheel 25. Diverse tilting options can be realized by varying the position of the pins relative to tilting shaft 26, and reversibility is provided. The device can thus be assembled on either side of a staircase without any major changes having to be made to the construction for this purpose, and the stock of different components for this purpose can be minimized. Rotation to the left or right can be selected and set.

Now that a specific embodiment of the present invention has been shown and described above, many alternative and additional embodiments will occur to the skilled person, which all lie within the scope of protection as according to the appended claims, unless these embodiments essentially differ from the claims. Within the scope of the invention a safety feature can thus be formed on the side of the tiltable segment instead of on the side of the stationary segment. The lever is in principle then unnecessary and can be omitted, although the arm must then be provided with engaging means which can engage a passing carriage over a limited distance in order to tilt the tiltable segment and then release the carriage. In addition, a control for propelling carriage 3, 4 is preferably adapted such that the advancing movement of the carriage is slowed down at a position before the outer end of the guide, or in any case where the engaging means "catch" the carriage for the purpose of a controlled tilting movement. The transmission can be designed in random manner, including embodiments where the tiltable segment lies against the stationary segment in the folded-up position, which also depends on the transmission ratio of a transmission to be selected here. The invention defined in the claims, and in particular the independent claims, is thus found to have many embodiments other than just those shown and described here.

The invention claimed is:

1. A device for transport along a staircase of persons and/or goods, which staircase extends between two platforms, the device comprising:

a guide which in the arranged situation extends at least along the staircase and includes a stationary segment and at least one movable segment;

a mechanism between the segments configured to selectively move the movable segment between a position lying in line with the stationary segment and a position substantially out of the space above one of the platforms;

a carriage with transport means for persons and/or goods having a drive for advancing movement along the guide; and a transmission adapted to selectively engage the carriage in the vicinity of the tilting mechanism for transmitting movement of the carriage along the guide onto the movable segment for movement thereof, wherein the movable segment is tiltable and the mechanism is a tilting mechanism for the transmission to selectively tilt the tiltable segment to and from the position out of the space, in which position the tiltable segment is folded away;

wherein the transmission comprises an arm movable substantially in a longitudinal direction of the guide and engaging means for selective engagement of the carriage, the transmission coupled to the tiltable segment; and wherein the engaging means comprise a lever with an engaging means for the carriage, the lever connected by means of a bush and a clamp connection to the arm and arranged pivotally on the guide.

2. The device as claimed in claim 1, further comprising a safety portion to prevent tilting of the pivotable segment if a resistance thereto occurs which is higher than a desired threshold resistance.

3. The device as claimed in claim 2, wherein the transmission is slip-free, and wherein a transmission ratio is selected subject to the distance to be covered by the arm in the longitudinal direction of the guide so as to tilt the tiltable segment between the positions thereof

4. The device as claimed in 1, wherein the connection between the arm and the lever is adapted to be broken at the threshold resistance or a higher resistance.

5. The device as claimed in claim 4, wherein the transmission is slip-free, and wherein a transmission ratio is selected subject to the distance to be covered by the arm in the longitudinal direction of the guide so as to tilt the tiltable segment between the positions thereof

6. The device as claimed in claim 1, wherein the transmission has a selected transmission ratio.

7. The device as claimed in claim 6, wherein the transmission is slip-free, and wherein a transmission ratio is selected subject to the distance to be covered by the arm in the longitudinal direction of the guide so as to tilt the tiltable segment between the positions thereof

8. The device as claimed in 1, wherein the transmission is slip-free, and wherein a transmission ratio is selected subject to the distance to be covered by the arm in the longitudinal direction of the guide so as to tilt the tiltable segment between the positions thereof.

9. The device as claimed in claim 8, wherein the transmission is a gear rack on the arm, a toothed wheel on the tiltable segment or a rod assembly on the tiltable segment.

10. The device as claimed in claim 9, wherein a transmission ratio is determined by the diameter of the toothed wheel.

11. The device as claimed in claim 1, wherein the device is a stair lift or a stair walking aid.

12. The device as claimed in claim 1, wherein the transport means is a chair or a hand grip.

13. A guide for a device for transport along a staircase of persons and/or goods with a carriage with transport means for persons and/or goods, and with a drive for advancing movement along the guide, which staircase extends between two platforms, and wherein, in the arranged situation, the guide extends at least along the staircase, the guide comprising:

a stationary segment and at least one tiltable segment;

a tilting mechanism between the segments configured to selectively tilt the tiltable segment between a position lying in line with the stationary segment and a position folded out of the space above one of the platforms; and a transmission adapted to selectively engage the carriage in the vicinity of the tilting mechanism so as to transmit movement of the carriage along the guide onto the tiltable segment for a tilting movement thereof;

wherein the transmission comprises an arm movable substantially in a longitudinal direction of the guide and engaging means for selective engagement of the carriage, the transmission coupled to the at least one tiltable segment;

wherein the engaging means comprise a lever with an engaging means for the carriage, the lever connected by means of a bush and a clamp connection to the arm and arranged pivotally on the guide.

14. The device as claimed in claim 13, wherein the device is a stair lift or a stair walking aid.

15. The device as claimed in claim 13, wherein the transport means is a chair or a hand grip.

* * * * *

UNITED STATES PATENT AND TRADEMARK OFFICE

CERTIFICATE OF CORRECTION

PATENT NO. : 7,523,807 B2
APPLICATION NO. : 10/558460
DATED : April 28, 2009
INVENTOR(S) : Vroegindeweij et al.

It is certified that error appears in the above-identified patent and that said Letters Patent is hereby corrected as shown below:

Column 1, delete the paragraph from Lines 38 to 49, beginning with "Devices are known wherein...." with the paragraph submitted on page 2 of the "Amended Sheets" filed November 28, 2005, which reads as follows:

Please insert;

-- From WO 99/42399 devices are known wherein the guide consists of stationary and movable components. The control hereby becomes complex and possible embodiments become expensive due to the complex control and the use of an additional motor. Such a device also requires safety precaution, for instance to prevent limbs being caught between the parts movable relative to each other, or to prevent the carriage continuing to travel along the guide while these parts are not aligned. This latter could result in a dangerous situation, wherein the carriage can become detached from the guide. --

Column 1, Line 52, "has the" should read -- has all of the --

Signed and Sealed this

First Day of September, 2009

David J. Kappos

David J. Kappos
*Director of the United States Patent and Trademark Office*